United States Patent [19]

Blum

[11] Patent Number: 4,810,890

[45] Date of Patent: Mar. 7, 1989

[54] PACKAGE FOR THE SHIPMENT OF DANGEROUS MATERIALS

[75] Inventor: Paul Blum, ST Nom La Breteche, France

[73] Assignees: Transnucleaire, S.A., Paris; Cogema (Compagnie Generale des Matieres Nucleaires), Velizy-Villacoublay, both of France

[21] Appl. No.: 920,087

[22] Filed: Oct. 17, 1986

[30] Foreign Application Priority Data

Oct. 17, 1985 [FR] France ..... 85 15413

[51] Int. Cl.[4] ..... G21F 5/00

[52] U.S. Cl. ..... 250/506.1; 250/507.1; 376/272

[58] Field of Search ..... 250/506.1, 507.1; 228/151; 376/272

[56] References Cited

U.S. PATENT DOCUMENTS

| | | | |
|---|---|---|---|
| 2,437,626 | 9/1943 | Tinsley | 228/151 |
| 4,447,729 | 5/1984 | Doroszlai et al. | 250/506.1 |
| 4,488,048 | 12/1984 | Bienek et al. | 250/506.1 |
| 4,532,104 | 7/1985 | Wearden et al. | 376/272 |
| 4,620,106 | 10/1986 | Olivieri et al. | 250/506.1 |

FOREIGN PATENT DOCUMENTS

| | | | |
|---|---|---|---|
| 0054944 | 6/1982 | European Pat. Off. . | |
| 4069916 | 9/1982 | Fed. Rep. of Germany | 250/506.1 |
| 6030108 | 7/1984 | Fed. Rep. of Germany | 250/506.1 |
| 1568340 | 5/1969 | France . | |
| 2258692 | 8/1975 | France . | |
| 5292450 | 3/1984 | Japan | 250/506.1 |
| 937764 | 9/1963 | United Kingdom . | |
| 2128128 | 4/1984 | United Kingdom . | |

*Primary Examiner*—Carolyn E. Fields
*Assistant Examiner*—John A. Miller
*Attorney, Agent, or Firm*—Fleit, Jacobson, Cohn & Price

[57] ABSTRACT

Package for shipping dangerous materials to ensure the containment of these materials under conditions of severe accident. A containment enclosure of austenitic stainless steel, constituted by a single part devoid of orifices and of joints other than welds, has the shape of a cylinder of revolution closed at its two ends which are of convex shape. The wall of this enclosure is of a substantially uniform thickness without sudden variations including the area of the welds. Two axial shock absorbers, each formed by a section of metal tube preferably of the same cross-section as the above enclosure, are positioned on the end of the latter so that they are coaxial therewith. A support ensures the storage and the handling of the assembly are provided, as well as if necessary, removable means adapted to ensure the wedging of the dangerous materials inside the enclosure.

7 Claims, 2 Drawing Sheets

Figure 2B:
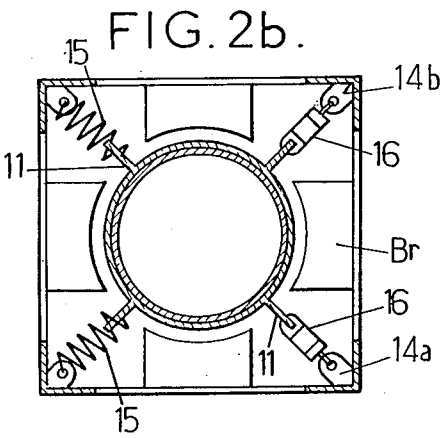

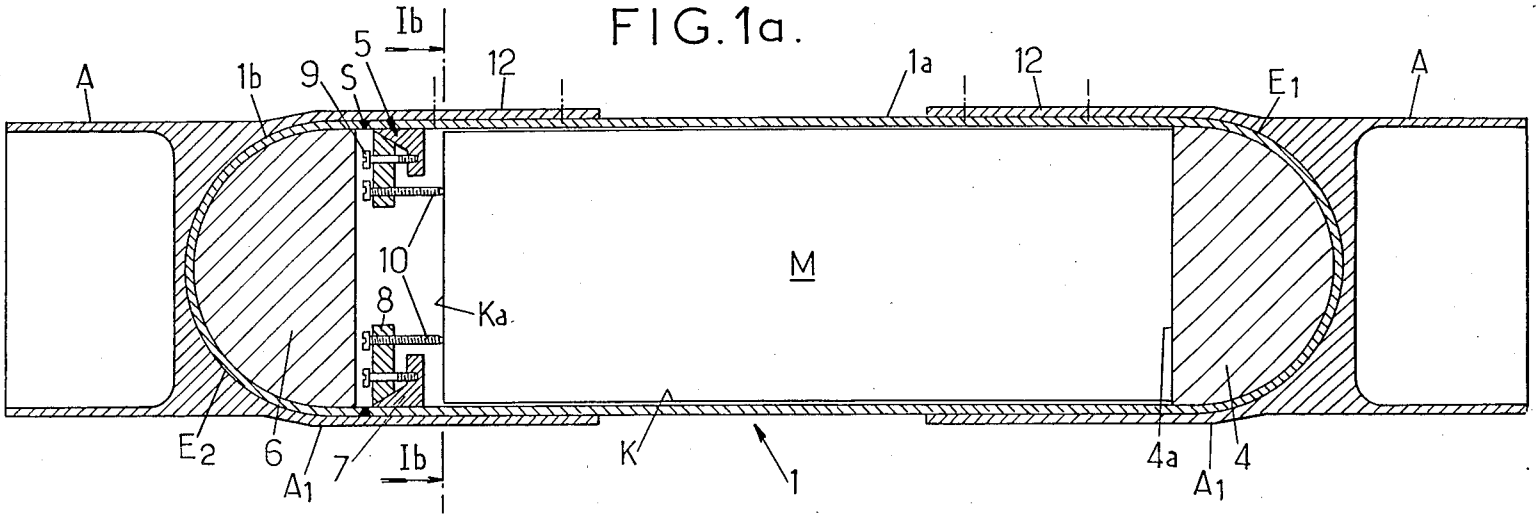
FIG. 1a.
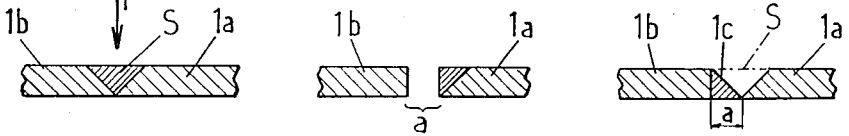
FIG. 4c.
FIG. 4b.
FIG. 4a.
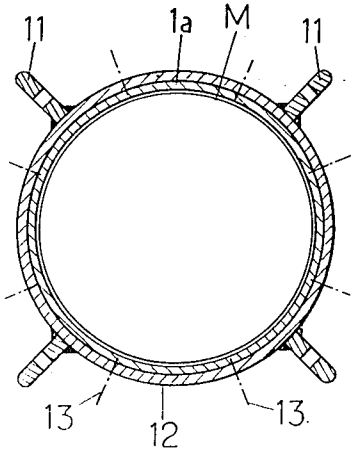
FIG. 1b.

PACKAGE FOR THE SHIPMENT OF DANGEROUS MATERIALS

The invention relates to a package for the shipment of dangerous materials, this package being arranged to ensure the containment of said dangerous materials under severe accidental conditions.

The dangerous materials for the shipment of which the package concerned is intended, comprise particularly non-irradiated nuclear fuel materials in solid form, namely previously conditioned powders, fuel slugs as well as complete fuel elements.

The severe accidental conditions under which the package must be adapted to ensure the containment of the dangerous materials, comprise particularly a succession of high speed shocks followed by a prolonged fire at high temperature.

Packages of the type concerned which exist already, comprise one or several containment enclosures equipped with a closure device comprising a cover whose fluid-tightness is obtained by means of seals and clamping by means of screws or the like; the more severe the accidental conditions which these packages must withstand, the more the reinforcements which must be applied to the closure devices are important, resulting in an increase in the mass of the package; it then becomes difficult to ensure the resistance of the less reinforced zones especially when there are sudden variations in the thickness of the wall, except by providing ancillary structures of the shock absorber type and heat insulations which although effective are heavy, bulky and expensive, thus rendering the shipments more difficult and costly, expecially in the case of transportation by air.

It is a particular object of the invention to overcome these drawbacks and to provide a package of the type concerned which, whilst resisting the more severe accidental conditions, has a size and weight facilitating transportation of all types, in particular by air.

This object may be achieved by making packages of the type concerned comprise

- a containment enclosure of austenitic stainless steel, constituted by a single part devoid of orifice and of joints other than welded, having the shape of a cylinder of revolution closed at its two ends which are of convex shape, the wall of this enclosure being of a substantially uniform thickness without sudden variations including in the area of the welds,
- two axial shock absorbers or dampers of axial shocks, each comprising a section of metal tube preferably of the same cross-section as the above enclosure, arranged at the ends of the latter so that they are coaxial with it,
- removable means adapted to ensure the storage and handling of the assembly as well as, if need be, removable means adapted to ensure the wedging of the dangerous materials within the enclosure, removable means adpated to ensure the suspension of the enclosure, removable means adapted to ensure the radiation shielding and removable means adapted to ensure heat dissipation.

In a first modification, the dampers of axial shocks are arranged so that they may be mounted by being nested or fitted onto the ends of the enclosure.

According to a second variation, the dampers of axial shocks are welded to the ends of the enclosure.

In all cases, these shock absorbers can comprise reinforcements such as concentric tubes and/or spacer tubes.

The removable structures of the above-said package may be fixed by friction, by protuberances included in the wall, by a box enclosing the enclosure.

The package according to th invention has also other features which are preferably used at the same time and which will be more explicitly considered below.

The invention will be well understood by means of the additional description and the drawing which are given with respect to advantageous embodiments.

FIG. 1*a* of said drawing shows in axial section the containment enclosure of a package arranged according to the invention.

FIG. 1*b* being a section along the line Ib—Ib of FIG. 1*a*.

Figure 2A:
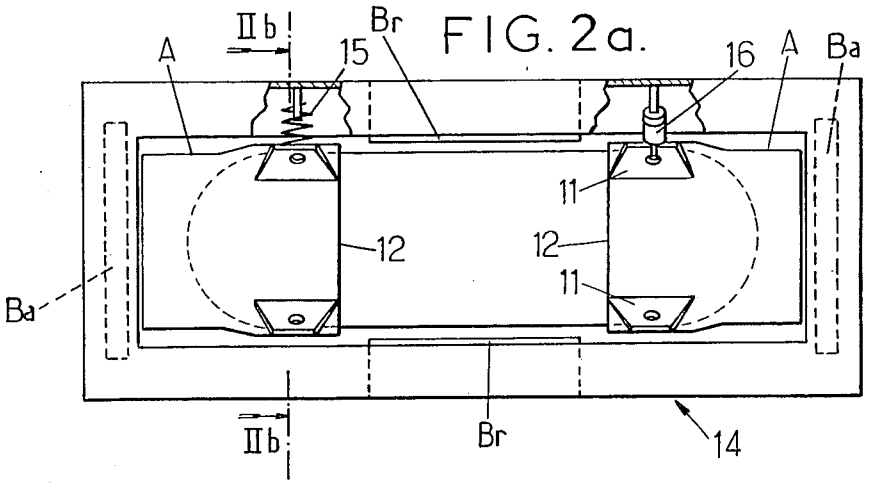

FIG. 2*a* shows an elevation with parts torn away, details of a package according to the invention, FIG. 2*b* being a section along the line IIb—IIb of FIG. 2*a*.

Figure 3B:
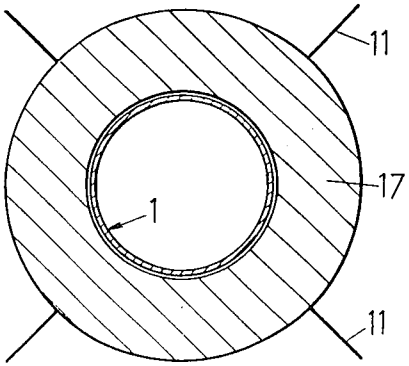
Figure 3A:
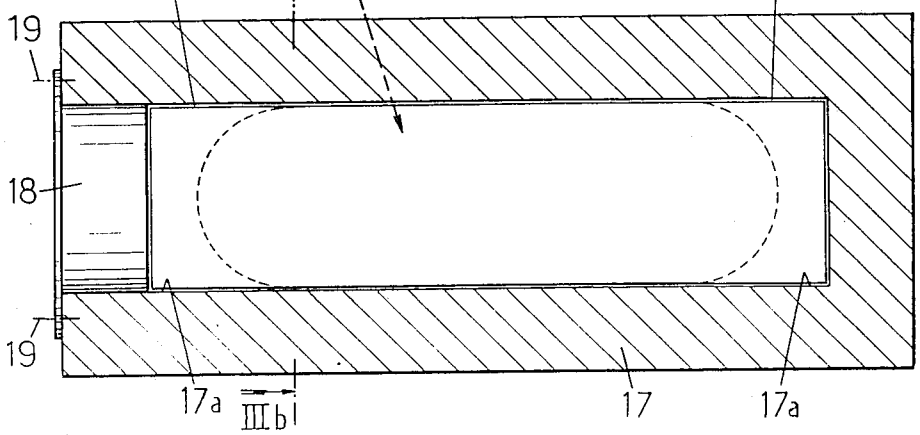

FIG. 3*a* shows, in partial axial section, a modification of the package shown in FIG. 2*a*, FIG. 3*b* being a section along the line IIIb—IIIb of FIG. 3*a*.

FIGS. 4, 4*b* and 4*c* show in section details of the containment enclosure of the above-said package.

Consequently, proposing to construct a package according to the invention, procedure is as follows or in equivalent manner.

This package is made to include a containment enclosure denoted generally at 1 and constituted by a single part, of austenitic stainless steel, in the form of a cylinder of revolution closed at its two ends which are of convex shape.

The thickness of the wall of this enclosure is substantially uniform without sudden variations, including in the area of the welds which will be discussed below.

The enclosure comprises two axial shock absorbers A each formed by a section of metal tube preferably of the same cross-section as the enclosure, each of these tubes being arranged respectively on one of the ends of the enclosure with which they are coaxial.

To take into account certain safety regulations, it is possible to arrange the coaxial dampers so that the enclosure-shock absorber assembly can withstand an impact at 470 km/h on a flat and undeformable target.

With the same purpose in mind, it is possible to confer on the wall of the enclosure a thickness such that it resists a fall from a height of 3 m onto a steel puncher or penetrating stamp of 2.54 cm diameter.

The containment enclosure is obtained by the joining, by butt-welding along S, on the one hand of a first constituent element 1*a* comprising the larger part of the cylinder of revolution and one of the ends E1 of the enclosure, that is to say the part which must receive dangerous materials M intended to be shipped and, on the other hand, by a second constituent element 1*b* comprising essentially the other end E2 of the enclosure, the second element serving the purpose of cover as in conventional packages.

The thus constituted enclosure is completely fluid-tight due to the weld S; this weld eliminates the need for any sealing joint, but must be checked by several means, especially by x-rays and/or ultra-sound, after completion.

The enclosure has walls of almost uniform thickness and in any case without abrupt variations even in the area of the welds and does not include an orifice; due to this constitution and to the presence of the damping tubes A, it is capable of withstanding shocks by absorbing the kinetic energy of the corresponding impacts by progressive plastic deformation of the whole.

In practice, when the thickness of the wall of the enclosure is not uniform, it varies preferably continuously, the ratio between the thickest zone and the less thick zone not exceeding 2.

The ends E1 and E2 of the enclosure 1 form convex bottoms which may be hemispherical, elliptical, in the shape of three-center curves or false ellipses and the like.

The shock absorber tubes A are positioned coaxially with the enclosure on the ends of the latter by welding or by fitting together thereonto.

It is the last embodiment which is shown in FIG. 1*a*, the shock absorber tube proper A then being adaptable to the end of the enclosure by a tube diameter A1 coaxial with A and of internal diameter such that this element A1 can be adapted to the end of the enclosure with a minimum of clearance, its fastening being ensured by pressure screws 13 tightened against the wall of the enclosure.

The shock absorber tubes A can be reinforced by coaxial tubes of smaller diameter (not shown) housed inside the tubes A and joined to the latter, for example, by fins.

By way of illustrative example which is in no way limiting, it is pointed out that an enclosure 1 adapted to house a fuel assembly PWR of 750 kg mass, of length 4.1 m and of square cross-section of 215 mm side is presented in the form of a cylinder of revolution of austenitic stainless steel of 380 mm diameter, of length 4.6 m and of wall thickness 25 mm, extended at each end by a damping tube of the same cross-section, of the same material and of 600 mm length.

The assembly has a mass of 2.5 t and withstands an impact at a speed of 470 km/h followed by a drop from a height of 3 m onto a steel puncher of 2.54 cm diameter.

A fundamental advantage of the enclosure comprised by the packages according to the invention lies in the fact that its replacement after each use can be envisaged at less expense due to its simple constitution, its ease of supply, its reduced weight and the possibility of recovering the dismountable appendages provided for its handling, its storage, its suspension, the blocking of its contents, its shielding, etc.; what renders this advantage still more determining is that besides, the constituent elements of this enclosure can also be recovered, by means of a method according to the invention which comprises a set of simple operations which will be more fully discussed.

The constituent material of the containment enclosure of the packages according to the invention is austenitic stainless steel in view of the well-known properties of this material from the standpoints of corrosion resistance, weldability, absence of fragility at low temperature, high mechanical properties among which are breaking elongation, high melting point.

The package comprises removable wedging means for dangerous materials M inside the enclosure. These removable wedging means may be made by means of members connected by friction with the enclosure, to prevent the wall of the latter from having areas of lower strength, in the case of impact.

Thus, in the case of the embodiment shown in FIGS. 1*a*, 1*b*, the rigid structure shown schematically at K, and on which is fixed a complete fuel element (not shown) and constituting the dangerous material M, is wedged between on the one hand, a spacer element 4 of malleable metal such as aluminum whose shape is complementary with that of the bottom of the end E1 of the first constituent element of the assembly in which it is positioned and against which spacer element the corresponding end of the rigid structure K is supported along 4*a* and on the other hand, a blocking system, generally referred to at 5, fixed to the enclosure by friction and which will be described, a spacer element 6 similar to the spacer element 4 being preferably housed in the end E2.

In a modification, the reaction of the blocking system can be taken up by protuberances of the enclosure, and the latter can be in the form of a continuous or interrupted ring (bayonet system) welded against the enclosure, the total thickness of the ring not exceeding the thickness of the wall of the enclosure.

In the case of the embodiment shown in FIG. 1*a*, the bottom of the ends E1 and E2 is convex, the spacer elements 4 and 6 having a complementary convex shape, due to which in the case of impact at the end the pressures are better distributed.

Still in the embodiment shown in FIG. 1*a*, the blocking system 5 comprises a split conical ring 7 cooperating with a wedging stop 8 which applies the split ring against the inner surface of the enclosure 1 under the action of axial screws 9, thus immobilizing the assembly 5, wedging screws 10 being provided to immobolize and center the rigid structure K on which the fuel element is fixed by reaction against the surface Ka of this structure on which they are supported.

The package comprises removable means for ensuring the storage and handling of the assembly, as well as, if need be, removable means adapted to ensure the suspension of the enclosure, removable means adapted to ensure the radiation shielding and removable means adapted to ensure heat dissipation.

The means adapted to permit the handling and storage of the enclosure 1, may be constituted by elements 11 which are advantageously borne by a tube or by an outer ring 12 applied against the enclosure and immobilized with respect to the latter by friction particularly by clamping screws 13.

In the case of the embodiment of FIG. 1*a*, the outer ring 12 may, as shown, be a constitutent part of tube A1.

By means of the abovesaid handling and storage members, the enclosure 1 can be held inside a frame or support shown in FIGS. 2*a* and 2*b* and generally denoted at 14, the holding in position within said frame being advantageously effected by means of elastic connecting elements which can be constituted by elastomeric blocks or, as in the embodiments shown in FIGS. 2*a* and 2*b*, by springs 15 and shock-absorbing devices or dampers 16 of the type used for the suspension of road vehicles, axial Ba and radial Br stops fixed to the frame limiting the amplitude of possible movements, taking over this suspension in the case of a sudden shock.

In the case of the embodiment shown, eight "spring 15+shock absorber dampers 16" units are positioned in the vicinity of the ends of the enclosure, being supported respectively on a fastening element 14*a* provided in each of the corners 14*b* of the frame and on one of the elements 11 of the rings 12. In addition, two axial stops Ba and the four radial stops Br limit the possible movements of the enclosure with respect to the frame.

Due to this method of procedure, the enclosure 1 is perfectly suspended and held in the case of a sudden shock on the inside of the frame 14 which can in its turn be fixed to the platform of a transport vehicle or a transcontainer (not shown).

Of course, the frame 14 may be replaced by a transcontainer and the latter can contain several enclosures 1, each suspended from a series of upright members 14 integral with the transcontainer.

It is also possible to shut the enclosure 1 equipped with its axial dampers and its own handling means in a closed box by conventional means of the clamp and screw type, toggle joints and the like, storage and handling members for the whole being provided outside the box; it is important to make sure that the mass and the structures of the box concerned should not risk causing rupture of the walls of the enclosure by crushing or piercing, in the case of impact of the whole at high speed onto a flat target.

Finally, when the nature of the dangerous material M requires it, this box can comprise a radiation shielding; the latter may be as shown in FIGS. 3*a* and 3*b* in the form of a box 17 of material adapted to ensure radiation protection (neutron and/or gamma): this box which is advantageously in the form of a cylinder of revolution comprising a cavity 17*a* in which the enclosure 1 equipped with its shock absorbers A and its handling members 11 is positioned, is closed by a cover 18 provided with a fluid-tight seal of the same material or of similar material, said cover 18 being fixable to the box by fastening screws 19.

In this case, the box 17 also comprises handling and storage emembers 11 and possibly cooling fins (not shown).

When the shielding is constituted by an insulating material (for example, resin), it is possible to provide heat bridges in the form of metal plates passing radially right through it from side to side.

As has already been indicated above, the constituent elements 1*a* and 1*b* of the enclosure 1 are joined by butt-welding along S, after positioning and blocking inside the elements 1*a* of the dangerous material M.

To extract the material M from the enclosure, the elements 1*a* and 1*b* are separated from one another by cutting off or sectioning in the vicinity of S along the arrow F (FIG. 4*a*), after removal of the shock absorber tubes A.

FIG. 4*b* shows a part of the elements 1*a* and 1*b* after sectioning, that is to say removal of a thickness a of constituent material of the enclosure.

To re-utilize the enclosure, in accordance with the method according to the invention, the edge of one of the constituent elements of the enclosure is, for example, welded on, e.g. on the edge of the element 1*b*, which edge results from the preceding cutting off, a ring 1*c* of thickness a of constituent material of the enclosure corresponding to the thickness of the constituent material removed on the preceding cutting off (FIG. 4*c*); the edges of the two constituent elements of the enclosure are bevelled off, one of which is reconstituted as has just been indicated, these edges are brought together in contact with one another after a new loading operation of the enclosure and they are jointed by butt-welding, whereby reconstituting S and controlling the operation as indicated above, for example by x-ray and/or ultra-sound.

This being the case and whatever the embodiment adopted, there is thus provided a package of the type concerned which shows, with respect to those pre-existing, numerous advantages among which are particularly that lying in the fact that with less handling the containment enclosure comprised by the package has notably improved strength characteristics and that lying in the fact that said enclosure may in practice be replaced on each utilization whilst being recoverable by a simple method.

I claim:

1. A container for the transportation of non-irradiated nuclear fuel materials in solid form, said container comprising:

a deformable receptacle for the containment of said materials, said deformable receptacle including a deformable vessel made of austenitic stainless steel having the shape of a cylinder with a first convex end and a second convex end, said first convex end and said second convex end each having a malleable spacer element, said deformable receptacle having a wall of a substantially uniform thickness devoid of orifices, discontinuities, and joints other than welds, axial shock absorbers made of two metal tubes respectively positioned on each end of said vessel so that they are coaxial therewith, said shock absorbers having approximately the same diameter as said deformable vessel, and removable means for enabling the fastening and the handling of the container, wherein the components of said container cooperate such that the container efficiently resists at least a shock of a speed of about 470 km/hr followed by a three meter high drop on a one inch puncher followed by a fire.

2. Container according to claim 1, wherein said removable means enables the wedging of said materials inside said deformable vessel, the suspension of said deformable vessel, the shielding against radiation and the dissipation of heat.

3. Container according to claim 1, wherein said axial shock absorbers comprise reinforcements selected from the group consisting of concentric tubes and spacers.

4. Container according to claim 1, wherein a rigid structure for locating said nuclear fuel materials is held by friction to an inner wall of said deformable vessel and wedged inside said deformable vessel between the two spacer elements of said vessel.

5. Container according to claim 1, wherein said removable means enabling the fastening and the handling of said container are constituted by tubes or rings immobilized by friction on the vessel and secured by protrusions provided to an outer wall of said vessel.

6. Container according to claim 1, wherein said deformable vessel is held inside a frame through elastic connecting elements constituted by spring and shock absorbing devices and stops limiting the movement of said deformable vessel inside said frame.

7. Method for reutilizing a deformable vessel for the containment of radioactive materials made of austenitic stainless steel having the shape of a cylinder with a first convex end and a second convex end, said first convex end and said second convex end each having a malleable spacer element, said deformable vessel having a wall of a substantially uniform thickness devoid of orifices, discontinuities, and joints other than welds, axial shock absorbers made of two metal tubes respectively positioned on each end of said vessel so that they are coaxial therewith, said shock absorbers having approximately the same diameter as said deformable vessel, and removable means for enabling the fastening and the handling of the vessel, wherein the components of said vessel cooperate such that the vessel efficiently resists at least a shock of a speed of about 470 km/hr followed by a three meter high drop on a one inch puncher followed by a fire, said vessel being opened by cutting of said deformable vessel into two constituent elements including a first constituent element including a major part of the cylinder and said first convex end and a second constituent element including said second convex end, withdrawal of said materials and loading of further materials into said vessel including the successive steps of welding to an edge of one of said two constituent elements of said deformable vessel, a ring of austenitic stainless steel whose thickness corresponds to that of the material removed when cutting said deformable vessel, machine-tooling of the edges of said two constituent elements, bringing said edges into contact with one another and joining said edges by welding.

* * * * *